United States Patent [19]

Houkes et al.

[11] Patent Number: 4,710,678

[45] Date of Patent: Dec. 1, 1987

[54] ELECTRODELESS LOW-PRESSURE DISCHARGE LAMP

[75] Inventors: Henk Houkes; Pieter Postma; Andreas C. Van Veghel, all of Eindhoven, Netherlands

[73] Assignee: U.S. Philips Corporation, New York, N.Y.

[21] Appl. No.: 725,441

[22] Filed: Apr. 22, 1985

[30] Foreign Application Priority Data

Apr. 24, 1984 [NL] Netherlands ..... 8401307

[51] Int. Cl.[4] ..... H05B 41/16; H05B 41/24

[52] U.S. Cl. ..... 315/39; 315/248; 315/85; 315/344; 336/69

[58] Field of Search ..... 315/248, 39, 85, 57, 315/242, 344; 336/69, 70

[56] References Cited

U.S. PATENT DOCUMENTS

| | | | |
|---|---|---|---|
| 2,692,372 | 10/1954 | Goldstine | 336/69 |
| 4,254,363 | 5/1981 | Walsh | 315/85 |
| 4,383,203 | 5/1983 | Stanley | 315/248 |

FOREIGN PATENT DOCUMENTS

| | | | |
|---|---|---|---|
| 39134 | 3/1980 | Japan | 315/248 |
| 66854 | 5/1980 | Japan | 315/248 |

*Primary Examiner*—David K. Moore
*Assistant Examiner*—Michael Razavi
*Attorney, Agent, or Firm*—David R. Treacy

[57] ABSTRACT

An electrodeless low-pressure discharge lamp having a lamp vessel (1), a core (3) of magnetic material, a first winding (7) arranged to surround the core and connected to a high-frequency supply unit (4), one of the lead-in wires of this winding being electrically connected to a lead-in wire of a second winding (11) with a free end (12), while during operation of the lamp the potential drop between the ends of the second winding is substantially equal to the potential drop between the ends of the first winding and the potential drops in the two windings vary in opposite senses. Interference currents at the supply mains to which the lamp is connected are then strongly suppressed.

4 Claims, 2 Drawing Figures

ELECTRODELESS LOW-PRESSURE DISCHARGE LAMP

Figure 1:
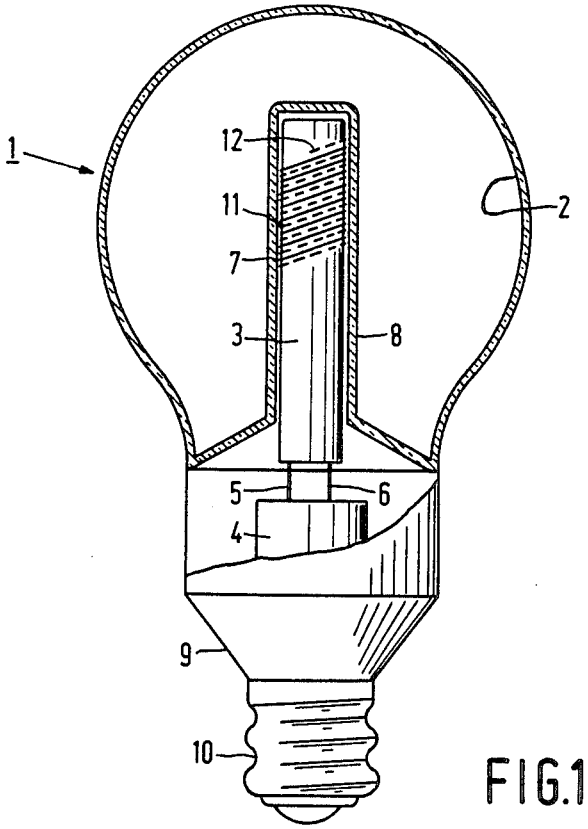

The invention relates to an electrodeless low-pressure discharge lamp comprising a lamp vessel which is sealed in a vacuum-tight manner and contains a metal vapour and a rare gas. The lamp is provided with a core of magnetic material in which during operation of the lamp a high-frequency magnetic field is produced by means of an electrical supply unit. A winding is connected thereto and arranged to surround the core. An electrical field then is produced in the lamp. Such a lamp is known from U.S. Pat. No. 3,521,120.

The lamp described in this patent specification is an electrodeless fluorescent low-pressure mercury vapour discharge lamp operated at high frequency and having a bulb-shaped lamp vessel and a lamp cap which are shaped so that the lamp can be readily screwed into a fitting for incandescent lamp. The high-frequency magnetic field present in lamps of this type during their operation is produced by means of a supply unit which comprises a high-frequency oscillator circuit having a frequency higher than 20 kHz.

It has been found that during operation of the said lamp, high-frequency electrical interference currents (originating from the lamp) can be readily produced in the conductors of the supply voltage. This can be explained by the fact that the winding can be considered as a high-frequency alternating voltage source which is connected via the parasitic capacity to ground and to the conductors of the supply voltage. These interference currents may give rise to interference of electrical apparatus which are connected to the same supply voltage or are arranged in the immediate vicinity of the lamp.

With regard to the maximum value of the admissible high-frequency interference currents in the supply voltage, international standards exist, which the said lamp should satisfy.

In order to reduce the interference currents to an acceptable value, according to the Netherlands Patent Application No. 82 05 025, a low-ohmic transparent conductive layer is applied to the inner wall of the lamp vessel and this layer is connected during operation of the lamp with one of the lead-in wires of the supply voltage. Stringent requirements are imposed on the resistance value of this layer, while at the same time a high transparency to visible light is necessary. It has been found that it is difficult to ensure that these conditions are simultaneously satisfied.

The invention has for its object to provide an electrodeless low-pressure discharge lamp which is suitable to be operated with a high-frequency supply voltage, in which the said interference standards are satisfied, while this lamp can be manufactured in a simple manner and has a high luminous efficiency.

According to the invention, an electrodeless low-pressure discharge lamp of the kind mentioned in the opening paragraph is for this purpose characterized in that one of the lead-in wires of the winding is electrically connected to a lead-in wire of a second winding with a free end. During operation of the lamp the potential drop between the ends of the second winding is substantially equal to the potential drop between the ends of the first winding. The potential drop in the first winding is in a sense opposite to that of the second winding. This second winding is adjacent the first winding and electrically insulated therefrom.

In the lamp according to the invention, during its operation the high-frequency electrical interference at the supply voltage is reduced to a value which satisfies the standard applying thereto.

The potential drop in a winding is to be understood to mean the decrease of the potential per unit length measured in the direction of the longitudinal axis of the winding. Due to the presence of the second winding having a substantially equally large but opposite potential drop, the electrical potential of the first winding causing the interference is entirely compensated for. The second winding is electrically not loaded. The strength of the magnetic field is substantially not influenced. The luminous efficiency of the lamp is therefore substantially equal to that of the known lamp.

The turns of the second winding are electrically insulated from the turns of the first winding.

In an embodiment of the lamp, the magnetic core is rod-shaped and is surrounded by a cylindrical glass wall portion of the lamp vessel. The second winding may then be arranged to extend around the inner surface of the cylindrical wall portion. However, the second winding is preferably wound, just like the first winding, around the magnetic core itself. The number of turns of the second winding is substantially equal to the number of turns of the first winding in order to obtain a satisfactory coupling and an optimum compensation of the electrical potentials produced. The interference currents then are suppressed to the greatest possible extent.

Favorable results were obtained with the aforementioned preferred embodiment of the lamp according to the invention, in which each turn of the second winding is located between two successive turns of the first winding.

It has been found that the interference is then suppressed to the optimum. Additional insulation measures between the two windings are then superfluous.

The invention is preferably used in electrodeless low-pressure discharge lamps in which the inner wall of the lamp vessel is provided with a luminescent layer, which converts the ultraviolet resonance radiation produced in the lamp vessel into visible light. These lamps are suitable to be used in living-rooms and the like and serve as an alternative to incandescent lamps for general illumination purposes.

Figure 2:
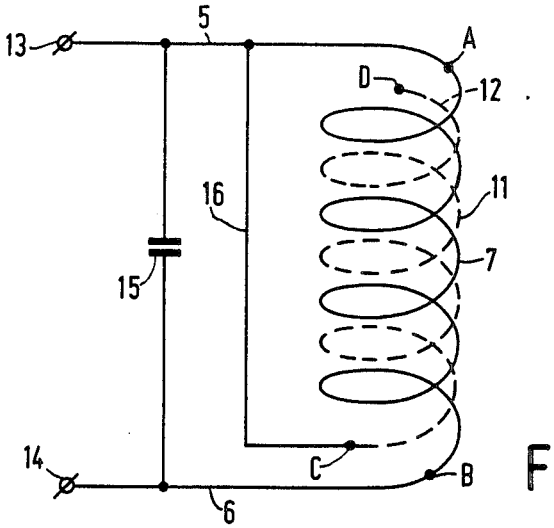

An embodiment of the invention will now be described more fully with reference to the accompanying drawing. In the drawing:

FIG. 1 shows, partly in elevation and partly in sectional view, an embodiment of an electrodeless low-pressure mercury vapour discharge lamp according to the invention, and FIG. 2 shows diagrammatically the relative position of the two windings around the core of the lamp shown in FIG. 1 and their circuit.

The lamp shown in FIG. 1 comprises a glass lamp vessel 1 which is sealed in a vacuum-tight manner and is filled with a quantity of mercury and a rare gas, such as argon. The inner wall of the lamp vessel is provided with a luminescent layer 2. The lamp is further provided with a rod-shaped core 3 of magnetic material, such as ferrite. During operation of the lamp a high-frequency magnetic field is produced by means of an electrical supply unit 4 and a winding 7 connected thereto through lead-in wires 5 and 6 and arranged to surround the core 3 (the lead-in wires are only partly visible in the drawing). This magnetic field extends into the lamp vessel 1, an electrical field being produced in the lamp vessel 1. The winding 7 comprises a number of turns of a narrow copper ribbon. The magnetic core 3 is located in a cylindrical indentation 8 in the wall of the lamp vessel 1 lying near the longitudinal axis of the lamp. The electrical supply unit 4 is arranged in a space which is surrounded by a lamp bowl 9 which is made of synthetic material and is connected to the lamp vessel 1. The end of the lamp bowl has secured to it an Edison lamp cap 10, by means of which the lamp can be screwed into a fitting for incandescent lamps.

The lead-in wire 5 of the winding 7 is electrically connected to a lead-in wire of a second winding 11. This winding is indicated in the drawing by dotted lines. The free end of second winding 11 is designated by reference numeral 12. This second winding 11 is secured so that during operation of the lamp the potential drop between its ends is substantially equal to the potential drop between the ends of the winding 7, but varies in a sense opposite to that of the voltage drop of the winding 7. This is explained more fully in FIG. 2.

The winding 11 comprises a substantially equal number of turns as the winding 7. The two windings are electrictrically insulated from each other. Each turn of the winding 11 is located between two successive turns of the winding 7.

In FIG. 2, the output terminals of the high-frequency supply unit are designated by reference numerals 13 and 14. A capacitor 15 is connected between these terminals. An alternating voltage having a frequency of 2.6 MHz is applied to the terminals. The winding 7 is also connected to the terminals via the lead-in wires 5 and 6. The lead-in wire 5 has connected to it a wire 16, which acts as a lead-in wire of the second winding 11, indicated by dotted lines. Each turn of the winding 11 lies at uniform distance from a successive turns of the winding 7. The free end of the winding 11 is designated by reference numeral 12.

For the sake of clarity, the magnetic core is omitted in FIG. 2. At a given instant, the voltage at point A is positive and the voltage at point B is negative. Point A is the first end of the winding 7 and point B is the second end thereof. At point C (the end of the winding 11), the voltage is then also positive. At the free end point D of the second winding, the voltage is negative. The electrical voltages in the two windings compensate each other so that, in use, the effects of varying voltages in the two windings are substantially cancelled out. At the lead-in wires of the supply voltage only high-frequency interference currents of small strength are then produced.

In a preferred embodiment, the lamp comprises a lamp vessel having a cylindrical rod-shaped core (length 50 mm, diameter 8 mm, Philips 4C6 ferrite), around which a first winding is arranged comprising thirteen turns of copper ribbon (width 0.38 mm, thickness 38 $\mu$m). The length of this winding is 25 mm (i.e., the distance between the outer turns measured along the longitudinal axis of the rod-shaped core). It has been found that with a second winding (also of copper ribbon, width 0.38 mm and thickness 38 $\mu$m) having 14.5 turns an optimum interference suppression is obtained. The length of the second winding is 30 mm. The interference suppression at the conductors of the supply voltage measures more than 45 dB when measured according to the international standard CISPR No. 15 (VDE 0871).

When a power of 18 W is supplied to the lamp, the luminous efficiency is about 1200 lumen. The inner wall of the lamp vessel is provided with a luminescent layer comprising a mixture of two phosphors, i.e. green luminescing terbium-activated cerium magnesium aluminate and red luminescing yttrium oxide activated by trivalent europium. The lamp vessel contains 6 mg of mercury as well as argon (70 Pa).

What is claimed is:

1. An electrodeless low-pressure discharge lamp comprising:

a lamp vessel which is sealed in a vacuum-tight manner and contains a metal vapor and a rare gas;

a core of magnetic material;

a first winding coupled by a pair of lead-in wires to a high-frequency voltage supply, the winding being arranged about the core so that during operation of the lamp an electrical field is produced in the lamp vessel and an inductive potential drop is induced in said winding;

means for connecting high frequency voltage supply to electrical supply conductors;

and the improvement comprising:

a second winding also arranged about the core, respective turns of the second winding being located adjacent successive turns of the first winding and electrically insulated therefrom, so that during operation a potential voltage is induced across ends of the second winding which is substantially equal and opposite said potential drop of the first winding; and one end of the second winding being electrically connected to one of the lead-in wires of the first winding, the other end of the second winding being free, said second winding being arranged such that parasitic capacitive coupling of interference currents to ground and said supply conductors is suppressed.

2. An electrodeless low-pressure discharge lamp comprising:

a lamp vessel which is sealed in a vacuum-tight manner and contains a metal vapor and a rare gas;

a core of magnetic material;

a first winding coupled by a pair of lead-in wires to a high-frequency voltage supply, the winding being arranged about the core so that during operation of the lamp an electrical field is produced in the lamp vessel and an inductive potential drop is induced in said winding;

means for connecting high frequency voltage supply to electrical supply conductors;

and the improvement comprising:

a second winding also arranged about the core, respective turns of the second winding being wound in the same sense as and located adjacent successive turns of the first winding and electrically insulated therefrom, so that during operation a potential voltage is induced across ends of the second winding which is substantially equal and opposite said potential drop of the first winding; and wherein each winding has a respective first end and a respective second end, said first ends being adjacent each other, and said second ends being adjacent each other; and the first end of one of said windings is electrically connected to the second end of the other of said windings with the other end of one winding being free, said second winding being arranged such that parasitic capacitive coupling of interference currents to ground and said supply conductors is suppressed.

3. An electrodeless low-pressure discharge lamp as claimed in claim 1, wherein the number of turns of the second winding being substantially equal to the number of turns of the first winding.

4. An electrodeless low-pressure discharge lamp as claimed in claim 1, characterized in that each turn of the second winding is located adjacent and between two successive turns of the first winding.

* * * * *